US006402892B1

(12) United States Patent
Kilpiä et al.

(10) Patent No.: US 6,402,892 B1
(45) Date of Patent: Jun. 11, 2002

(54) DRYING SECTION OF A PAPER MACHINE WITH A CLOSED DRAW TO A CALENDER SECTION

(75) Inventors: Jukka Kilpiä, Muurame (FI); Robert Baril, Verdun (CA)

(73) Assignee: Valmet Corporation, Helsinki (FI)

( * ) Notice: Subject to any disclaimer, the term of this patent is extended or adjusted under 35 U.S.C. 154(b) by 0 days.

(21) Appl. No.: 09/508,858

(22) PCT Filed: Sep. 14, 1998

(86) PCT No.: PCT/FI98/00716

§ 371 (c)(1),
(2), (4) Date: May 22, 2000

(87) PCT Pub. No.: WO99/14427

PCT Pub. Date: Mar. 25, 1999

(30) Foreign Application Priority Data

Sep. 18, 1997 (FI) ..... 973725

(51) Int. Cl.[7] ..... D21F 5/04; D21G 1/00

(52) U.S. Cl. ..... 162/207; 162/359.1; 162/375; 162/381; 100/304; 100/331; 34/116; 34/117

(58) Field of Search ..... 162/135, 193, 162/207, 265, 359.1, 375, 381; 34/116, 117; 100/303, 304, 331

(56) References Cited

U.S. PATENT DOCUMENTS 3,868,780 A * 3/1975 Soininen ..... 34/116
5,050,317 A * 9/1991 Kade et al. ..... 34/117
5,105,561 A 4/1992 Wulz ..... 34/117
5,163,236 A 11/1992 Heikkilä ..... 34/115
5,590,476 A 1/1997 Alakoski et al. ..... 34/117
6,183,601 B1 * 2/2001 Otto et al. ..... 162/205

* cited by examiner

*Primary Examiner*—Karen M. Hastings
(74) *Attorney, Agent, or Firm*—Steinberg & Raskin, P.C.

(57) ABSTRACT

In a method at the end of the drying section of a paper machine, drying cylinders (1, 2) are arranged in two substantially horizontal cylinder rows, wherein the first drying cylinders (1) are placed substantially higher than the second drying cylinders (2). In the method, the web (W) to be dried is conveyed alternately between the cylinder rows of the drying cylinders (1, 2). Further in the method, the transfer of the web (W) between the drying cylinders (1, 2) is supported by a wire run arrangement, and the web is guided after the last drying cylinder (1, 2) of the drying section (A) by a transfer arrangement in between the rolls of a pair of rolls in the calender section (B) of the paper machine. In the method, after the uppermost horizontal cylinder row ($SR^1$) formed by the first drying cylinders (1), at least one drying cylinder (1') is placed in such a way that the upper surface of its mantle lies substantially higher than the level defined by the upper surfaces of the mantles of the drying cylinders (1) of the upper horizontal cylinder row ($SR^1$), and the web (W) is conveyed through this upper drying cylinder (1'), while being supported by a continuous support means, such as a support wire (3), towards the calender section (B). By placing several drying cylinders (1', 2') at levels one higher than the other, the web can be conveyed to the height of the upper portion of the calender section, and the drying section can simultaneously be shortened in the longitudinal direction of the machine.

11 Claims, 3 Drawing Sheets

DRYING SECTION OF A PAPER MACHINE WITH A CLOSED DRAW TO A CALENDER SECTION

FIELD OF THE INVENTION

The invention relates to a method at the end of a drying section of a paper machine.

BACKGROUND OF THE INVENTION

In the drying section of a paper machine, drying cylinders are generally placed in two horizontal rows of cylinders, whereby the first drying cylinders are situated substantially higher than the second drying cylinders. In this kind of an arrangement, the web to be dried runs alternately between the drying cylinders of the cylinder rows, the web being supported by the support wire of the cylinder row on the drying cylinders. The main purpose of the support wire arrangement is to press the web into a drying contact with the surfaces of the cylinders and to support the web when running on the surface of the drying cylinders. Between the cylinders of different cylinder rows, the web runs free. Also, Finnish Patent 82850 discloses a multi-cylinder dryer placed after a paper coating machine, wherein a dryer wire and a coated web run first through cylinders arranged in a vertical row and subsequently through cylinders arranged in horizontal rows.

After drying, the web is transferred to the calender section of the paper machine for final treatment of the web. In the machine type that this invention relates to, the calender rolls are placed in the calender section in a vertical row as a so-called roll stack, and the web runs in the calender section from the top downwards; consequently, the web must be brought from the drying section, where it is close to the floor level of the paper machine, to the height of the top of the calender section which is situated considerably higher.

For this purpose, a transfer arrangement is generally provided between the drying section and the calender section, comprising one or several transfer rolls for guiding the run of the web. The transfer rolls are placed one above the other to guide the web along a vertical route, whereby the uppermost transfer roll is approximately at the height of the two uppermost calender rolls of the calender section.

Passing the web intact in the transfer arrangement primarily requires the supporting of the web by transfer rolls arranged at sufficiently short intervals, whereby so-called flutter of the web is avoided. Consequently, the transfer arrangement forms a distinct part of the paper machine, requiring a space of its own in the paper machine. In spite of a number of transfer rolls, the distances between the rolls remain long enough to complicate the run of the web, particularly with light paper qualities. Moreover, threading requires special measures for the same reason.

The purpose of the present invention is to present a novel method for bringing the web from the drying section to the calender section and simultaneously to improve the prior art in the field.

OBJECTS AND SUMMARY OF THE INVENTION

Using the method of the invention it makes it possible to bring the web from the drying section to the calendering section with a separate transfer arrangement comprising several transfer rolls.

In the method, the web is guided by one or several drying cylinders which are located substantially higher than the drying cylinders situated in the upper horizontal row of cylinders at the end of the drying section, whereby the web is guided closer to the uppermost calender rolls while it is still being carried and dried by the drying cylinders.

The method of the invention has particularly two significant advantages. When the web is brought at the end of the drying section by the drying cylinders in vertical direction, deviating from the general horizontal direction of the drying section, it is possible to reduce substantially the floor surface required by the drying section, when it is simultaneously possible to bring the web towards the upper part of the calender section, i.e., said drying cylinders form simultaneously at least part of the transfer arrangement for guiding the web from the drying section to between the rolls of the calender section. Thus, the length of the drying section can be changed in a way that the placement of the calender in an existing paper machine will not increase the total length of the paper machine or reduce the drying capacity. On the other hand, by using this method, the web can be brought into the calender section more securely than by known methods and with a smaller risk of damaging the web, because the open draw between the cylinders of the drying section and the calender rolls is shortened. These advantages are obtained particularly when the wire run arrangement that makes an essential part of the drying section is extended to cover also the cylinders carrying the web in the vertical direction, whereby the web can be carried in a particularly controlled manner. Also the threading of the web is facilitated for the said reasons, and it is possible at this point to use threading systems of the drying section. Thus, conventional edge strip threading to the calender, performed with ropes or blows, will be rendered unnecessary, or the threading strip, leader, can be cut at an advantageous point of the web first in the immediate vicinity of the first nip of the calender.

The invention relates also to an apparatus for applying the method. The apparatus comprises at least one drying cylinder which is situated higher than the level of the upper cylinder row in the end of the drying section before the calender section.

In the case that several drying cylinders are placed higher than the upper horizontal cylinder row, they can be placed in two successive vertical cylinder rows in the machine direction, that is, longitudinal direction of the machine, whereby the uppermost drying cylinder of this upwards directed end can be placed approximately at the height of the uppermost calender rolls. A transfer arrangement of rolls is thus at least partly replaced by drying cylinders.

This construction gives naturally also substantial costs savings, because the transfer arrangement with transfer rolls, required by known constructions, is mainly rendered unnecessary. One should note that these advantages are obtained without having to increase the height of the space required by the paper machine from the height required by the calender section as such. Moreover, there is no need to increase the number of drying cylinders, but the upwards directed transfer can be implemented by using those cylinders of the drying section, with the respective drying capacity, that would normally be located in horizontal rows, i.e., the end of the drying section is, in a way, "lifted up" and, as a result, the drying section becomes shorter in the machine direction. The placement of the drying cylinders in vertical cylinder rows, their drive and their heating, or the introduction of suction into them can be accomplished also with relatively simple constructions previously used in drying sections.

BRIEF DESCRIPTION OF THE DRAWINGS

The invention will be illustrated in more detail in the following description, with reference to the appended drawings. In the drawings.

DETAILED DESCRIPTION OF THE PREFERRED EMBODIMENTS

Figure 1:
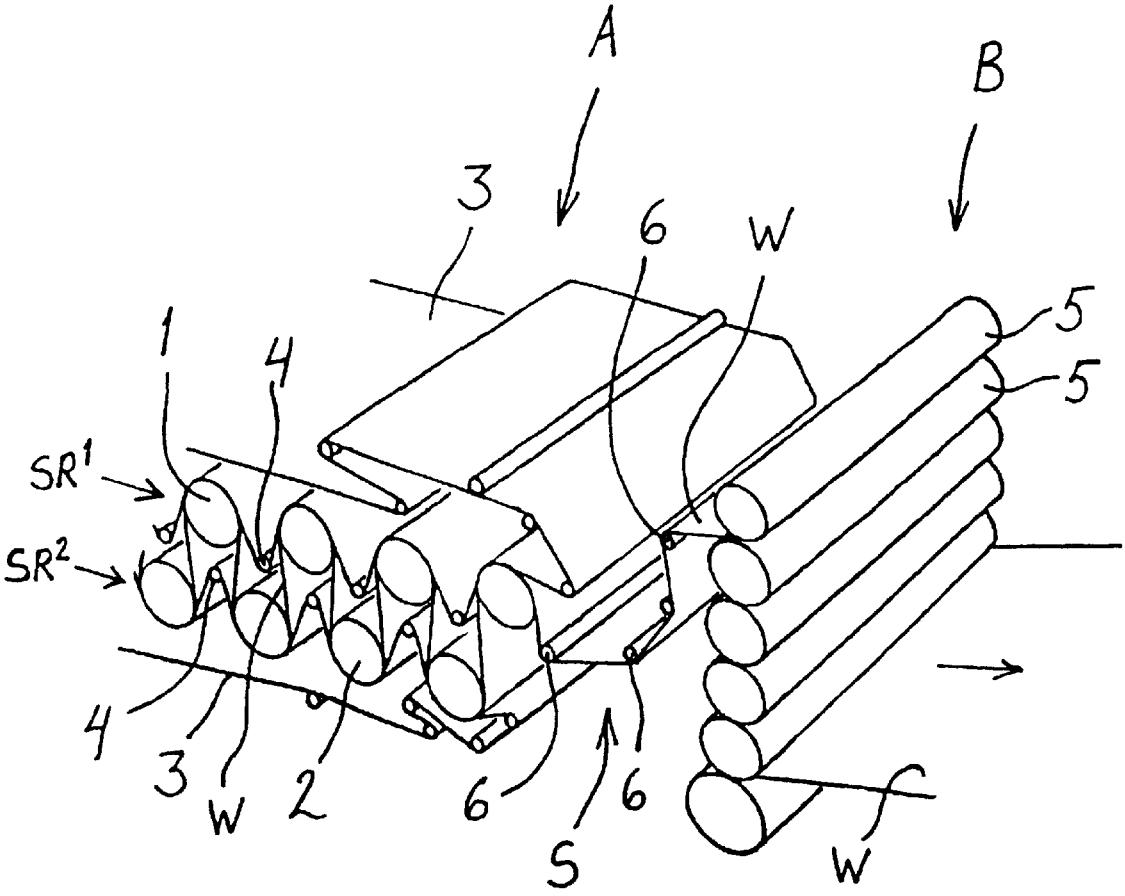
PRIOR ART Fig. 1
FIG. 1 shows a prior art application of the end of the drying section and the calender section of a paper machine in a simplified perspective view.

The drying section A consists primarily of drying cylinders 1, 2 which are placed preferably in two cylinder rows $SR^1$, $SR^2$, wherein the web W to be dried runs alternately between the cylinder rows $SR^1$, $SR^2$ from one drying cylinder 1, 2 to another, simultaneously traveling towards the end of the drying section A and to the calender section B of the paper machine. For pressing the web W to a drying contact with the surfaces of the drying cylinders 1, 2 and for supporting the run of the web W on the same, the end of the drying section A in particular is equipped with a so-called 2-wire run (double-felted) arrangement. The run of support wires 3 is guided with wire guide rolls 4. As shown in FIG. 1, between the drying section A and the calender section B there is provided a transfer arrangement S by means of particular transfer rolls 6 for carrying the web W from the drying section A to the calender section B. The transfer arrangement S is needed particularly because the web W must be lifted a considerably long distance from the vicinity of the floor level of the paper machine in between the two uppermost calender rolls 5 of a substantially vertical row of calender rolls. Without a sufficient number of transfer rolls 6, the web W can easily be damaged, e.g. due to so-called flutter.

Figure 2:
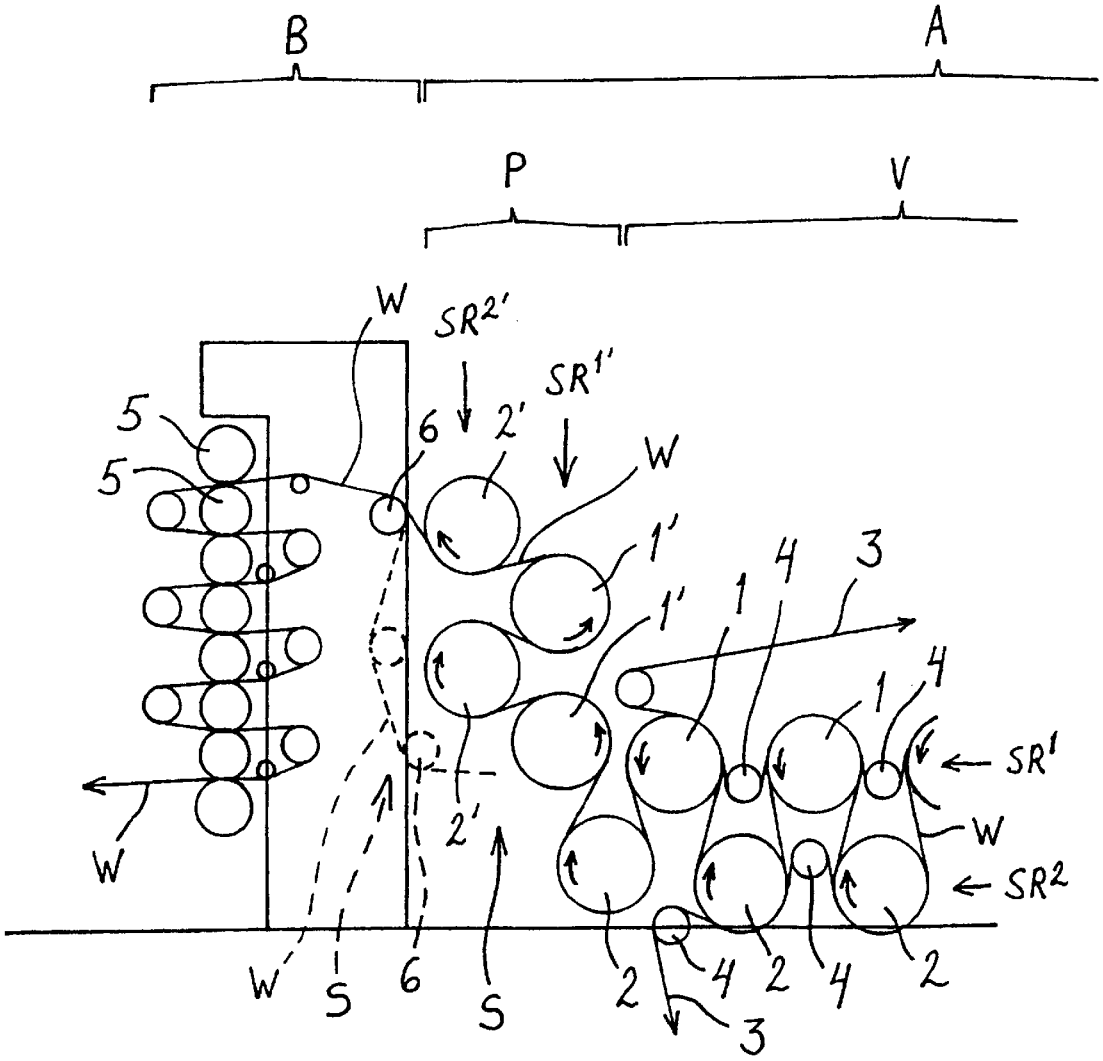
FIG. 2 shows the end of the drying section and the calender section according to the invention, seen from the side.

According to the inventive idea shown in FIG. 2, the transfer arrangement S lifting the web W upwards and passing it towards the calender section B, consists at least partly of the last drying cylinders 1, 2 of the drying section A, whereby two cylinder groups are formed at the end of the drying section immediately before the calender section B, namely a cylinder group V consisting of substantially horizontal cylinder rows and the last cylinder group P for carrying out the vertical transfer. According to the presented advantageous embodiment, the drying cylinders 1', 2' of the cylinder group P are arranged in two substantially vertical cylinder rows $SR^{1'}$, $SR^{2'}$ as direct extensions of the substantially horizontal cylinder rows $SR^1$, $SR^2$. Also in this last cylinder group P, the web runs in a serpentine manner between the rows $SR^{1'}$, $SR^{2'}$. The last cylinder group P comprises advantageously a sufficient number of drying cylinders 1', 2' so that after the web W has passed over the uppermost drying cylinder 1', 2' it is, measured in height direction from the floor level of the paper machine, close to the two uppermost calender rolls 5 of the calender section B, i.e., close to the press nip of these calender rolls 5. Thus, at least one part of the uppermost drying cylinder is at the same height as some part of the uppermost calender rolls 5. Because the uppermost drying cylinder 1', 2' is, however, located at a distance in the longitudinal direction from the uppermost calender rolls 5, it is advantageous to arrange on this distance at least one transfer roll 6 in the frame of the calender section B. Eliminated transfer rolls 6, which would normally be used, as well as the conventional passage of the web through them, are shown by broken lines.

As illustrated in FIG. 2, drying cylinder 2, which is placed immediately before the first cylinder 1' of the cylinder group P in the running direction of the web W, is already lifted higher from the level of the lower horizontal cylinder row $SR^2$, i.e., the vertical run of the web W is prepared for already at this point. After this, the drying section rises up step by step while simultaneously maintaining the principle of the serpentine run, i.e., the web runs on each drying cylinder in a certain sector, which in the middle cylinders of the group is advantageously larger than 180°. The last, uppermost drying cylinder 2' which is in the row $SR^{2'}$ next to the calender section, is in contact with the web above the same in a smaller sector than the preceding cylinders and guides the web W to the calender section. The number and geometry of the cylinders 1', 2' placed above the level of the upper horizontal cylinder row of the cylinder group V can be selected according to the space available and the height of the stack of calender rolls. For example, there can be two cylinders 1' in the first vertical row $SR^{1'}$ and only one cylinder 2' in the second vertical row $SR^{2'}$, whereby the last cylinder 1' of the first row, being simultaneously the uppermost cylinder of the whole group P, guides the web W further towards the calender section.

It is obvious that the cylinder rows $SR^{1'}$, $SR^{2'}$ of the cylinder group P arranged after the end of the cylinder group V can be placed diagonally in a direction slanting upwards towards the upper end of the stack of calender rolls in the calender section B, or in a fully upright position, and the inclination or the steepness of the ascent of the cylinder rows can vary depending on the space available or the desired saving on space in the machine direction.

For carrying out the invention, it is possible to arrange the last cylinders 1', 2' at the end of the drying section A also in another geometry than presented above. It is essential in the invention that at the end of the drying section, after the last horizontally running cylinder group V, there is at least one drying cylinder above the level of the upper horizontal cylinder row $SR^1$ of this preceding group V. The location of the cylinder above the level of the preceding cylinder row means that the upper surface of the cylinder mantle is higher than the level determined by the upper surfaces of the mantles of the cylinders 1 in the cylinder row $SR^1$. As presented above, before the calender section B there is advantageously still one or more drying cylinders 1', 2' being in contact with and guiding the web W above the upper position cylinder 1'. According to the definition presented above, these drying cylinders 1', 2' are placed one above the other, i.e., the upper surfaces of the cylinder mantles are at different heights.

Figure 3:
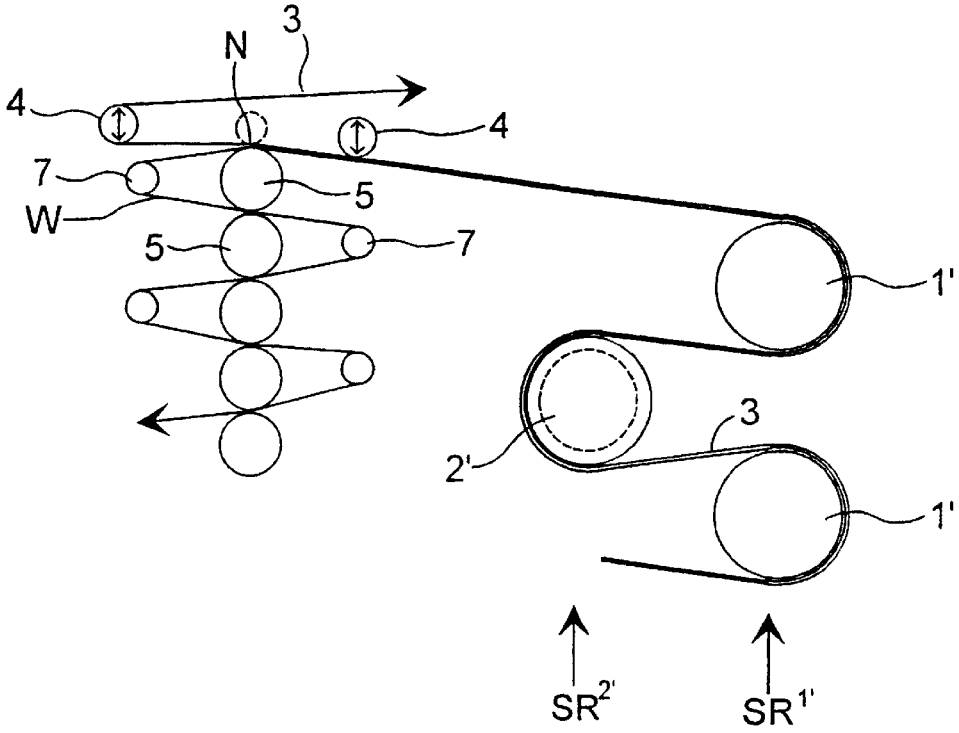
FIG. 3 shows one embodiment of the end of the drying section.
Figure 4:
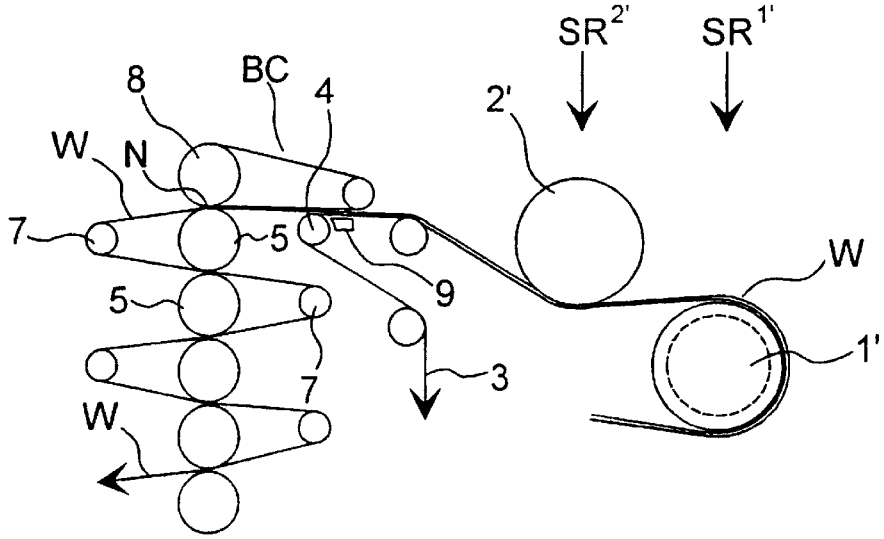
FIG. 4 shows another embodiment of the end of the drying section.

FIG. 2 shows a conventional wire guiding arrangement in the area of the cylinder group V of the normal principle, and the wire run in the area of the cylinder group P is not shown. FIGS. 3 and 4 show how the support wires 3 of the cylinder group V are extended to this area. FIG. 3 shows three last cylinders of the cylinder group P, through which the web W is run supported by the support wire 3 as a one-wire run, i.e., the web W is always in contact with the wire when passed in a serpentine fashion through the cylinders. The last cylinder, which the web W leaves, under support by the support wire 3, towards the calender section B, is the last cylinder 1' of the first vertical row $SR^{1'}$. The support wire 3 is passed up to the uppermost calender roll 5, and it is tensioned against the calender roll by means of a wire guiding roll 4, whereby the web W is left between the wire and the calender roll 5, and a pre-nip N is formed at this point against the hard calender roll 5. The tension can be adjusted also by a wire guiding roll 4 which is in contact with the support wire 3 before the calender roll and is movable in the same way as the wire guide roll 4 after the calender roll 5. An additional load can be effected by an additional roll shown by broken lines in the figure pressing the support wire 3 at the point of the calender roll 5. The web W can be transferred by blowing or in another way from the support wire 3 to a take-out leading roll 7 situated after the uppermost calender roll 5. From the take-out leading roll 7, the web is carried further in a known manner to the other side of the stack of calender rolls through a nip between the uppermost hard calender roll 5 and the next highest soft calender roll 5. FIG. 4 in turn shows an alternative whereby the last cylinder of the group P which the web W leaves under support by the support wire 3 towards the calender section B is the last cylinder 2' of the second vertical row $SR^{2'}$. The support wire 3 transfers the web before the calender stack to a belt calender BC, whose belt is wound around a roll 8 lying against the uppermost hard calender roll 5 and supports the web W on the final portion of the support wire 3 on a short distance together with the support wire 3. A pre-nip N is formed also between the uppermost calender roll 5 and the roll 8 of the belt calender, before the actual nips of the stack of calender rolls. After this, the web is conveyed through the take-out leading roll 7 and the nip between the hard and soft calender roll, as shown in FIG. 3. The transfer of the web onto the belt of the belt calender is facilitated by blowing performed on the other side of the support wire 3 before the wire guide roll 4 turning the direction of the wire. The blowing can be implemented by using a known blow box or blow nozzle 9. By virtue of closed draws of the web along the whole route as presented above, it is possible to conduct a full-width threading up to the calender section B.

The support wire 3 which conveys the web through the group P can be a separate support wire, but advantageously it is a support wire 3 for the group V of horizontal cylinder rows, extended to the area of the group P. Due to machine geometry, in the case of FIG. 3 the support wire is the support wire for the upper row $SR^1$ and in the case of FIG. 4 it is the support wire for the lower row $SR^2$.

The drying cylinders 1', 2' of the last group P can be heated cylinders, unheated cylinders (either equipped with or without heating apparatus), or coolable cylinders. They can also be suction cylinders which hold the web W by negative pressure. For example in FIG. 3, the cylinder 2' of the second vertical row $SR^{2'}$, at which the web W runs outermost, is a suction cylinder, and the last cylinder 1' can be a heated cylinder, an unheated cylinder or a cooled cylinder. The situation is reverse in FIG. 4, in which the cylinder 1' of the first vertical row $SR^{1'}$ is a suction cylinder, and the following, last cylinder 2' of the group P can be a heated cylinder, an unheated cylinder or a cooled cylinder.

Instead of the support wire 3, it is possible to use other known continuous support means for drying sections, such as dryer felts, and their running and route is analogous to that of the support wire 3.

The invention can be used in various types of drying sections, for example in drying sections where the web is guided and supported in the successive groups of drying cylinders by a single support wire of the respective group by a so-called single-wire draw principle. The drying section can also contain groups with a single wire and especially at the end of the drying section one or several groups with a twin-wire draw as shown by FIGS. 1 and 2.

What is claimed is:

1. Method at the end of the drying section of a paper machine, comprising the steps:

arranging drying cylinders (1, 2) in two substantially horizontal cylinder rows, wherein the first drying cylinders (1) are placed substantially higher than the second drying cylinders (2) to form an upper horizontal cylinder row, conveying the web (W) to be dried alternately between the cylinder rows of the drying cylinders (1,2), and guiding the web (W) is after the last drying cylinder (1, 2) of a cylinder group (V) formed by horizontal cylinder rows of the drying section (A) by a transfer arrangement in between the rolls of a pair of rolls in a calender section (B) of the paper machine, wherein in the direction of travel of the web, after the uppermost horizontal cylinder row ($SR^1$) formed by the first drying cylinders (1), at least one upper drying cylinder (1') is placed in such a way that the upper surface of its mantle lies substantially higher than the level defined by the upper surfaces of the mantles of the drying cylinders(1) of the upper horizontal cylinder row (SR1) preceding the said at least one upper drying cylinder, wherein a continuous support means supporting the web runs through a horizontal cylinder row, and said continuous support means is extended and guided through said at least one upper drying cylinder to the calender section in a closed draw for conveying the web to a calender section.

2. Method according to claim 1, wherein the web is conveyed towards the calender section (B) after said at least one upper drying cylinder (1') by means of one or several drying cylinders (1', 2') placed higher than said at least one upper drying cylinder and by means of the continuous support means, running through said one or several drying cylinders placed higher than said at least one upper drying cylinder.

3. Method according to claim 2, wherein said at least one upper drying cylinder and said one or several drying cylinders placed higher than said at least on upper drying cylinder make up a group (P) in which the drying cylinders (1', 2') are placed in two substantially vertical, successive rows of cylinders in the machine direction in such a way that the upper surface of the mantle of each drying cylinder (1', 2') is higher than the upper surface of the drying cylinder (1', 2') preceding it in the travel direction of the web, and the web (W) is guided along a serpentine route between the cylinders (1', 2') of these different cylinder rows while being supported by the continuous support means.

4. Method according to claim 1, wherein the web (W) is guided through the uppermost calender roll (5) of the calender section (B) while being supported by the continuous support means, such as a support wire (3).

5. Method according to claim 1, wherein the web (W) is guided to a belt of a belt calender while being supported by the continuous support means, the belt guiding the web (W) through the uppermost calender roll (5) of the calender section (B).

6. Apparatus at the end of the drying section of a paper machine, comprising:

first drying cylinders (1) and second drying cylinders (2), at least part of which form two substantially horizontal cylinder rows ($SR^1$, $SR^2$), wherein the cylinder row ($SR^1$) of first drying cylinders (1) is placed substantially higher, seen from the floor level of the paper machine, than the cylinder row ($SR^2$) of second drying cylinders (2) to form an upper horizontal drying cylinder row, wherein after the upper horizontal cylinder row ($SR^1$) of first drying cylinders (1), the upper surface of the mantle of at least one drying cylinder (1') is placed higher, seen from the floor level of the paper machine, than the level defined by the upper surfaces of the mantles of drying cylinders (1) in the preceding upper horizontal cylinder row ($SR^1$), wherein a continuous support means supporting the web and running through a horizontal cylinder row is extended and guided through said at least one upper drying cylinder (1'), to a calender section (B), in a closed draw for conveying the web to the calender section.

7. Apparatus according to claim 6, wherein after said at least one upper drying cylinder (1) in the direction of travel of the web, there are one or several drying cylinders (1', 2') placed higher than said at least one upper drying cylinder, the continuous support means being guided through said one or several drying cylinders placed higher than said at least on upper drying cylinder.

8. Apparatus according to claim 7, wherein said at least one upper drying cylinder and said one or several drying cylinders placed higher than said at least one upper drying cylinder make up a cylinder group (P) which is placed between a group (V) of substantially horizontal cylinder rows ($SR^1$, $SR^2$) and the calender section (B), and in which the upper surface of the mantle of each drying cylinder (1', 2') is located higher tan the upper surface of the mantle of the drying cylinder (1', 2') preceding it in the direction of travel of the web (W), wherein the drying cylinders (1', 2') of the group (P) make up two substantially vertical cylinder rows ($SR^1$, $SR^2$), the drying cylinders (2') of the second cylinder row (SR2) being closer to the calender section (B) than the drying cylinders (1') of the first cylinder row ($SR^1$) in the machine direction.

9. Apparatus according to claim 8, wherein the drying cylinder (2') placed uppermost in said cylinder group (P) is located at least partly at the same height, seen from the floor level of the paper machine, than the two highest calender rolls (5) of the calender section (B).

10. Apparatus according to claim 6, wherein the continuous support means supporting the web is passed up to the uppermost calender roll (5) of the calender section (B).

11. Apparatus according to claim 6, wherein the continuous support means supporting the web is passed up to a belt calender running through the uppermost calender roll (5) of the calender section (B).

* * * * *